United States Patent [19]

White

[11] 4,282,416

[45] Aug. 4, 1981

[54] UNITIZED STRUCTURE FOR A MICROWAVE OVEN

[75] Inventor: James A. White, Louisville, Ky.

[73] Assignee: General Electric Co., Louisville, Ky.

[21] Appl. No.: 935,445

[22] Filed: Aug. 21, 1978

[51] Int. Cl.[3] ..... H05B 6/64

[52] U.S. Cl. ..... 219/10.55 R; 126/21 R; 126/273 R; 312/236

[58] Field of Search ..... 219/10.55 R, 10.55 F; 312/236, 237; 126/21 A, 273 R, 273 A, 275 R, 275 E

[56] References Cited

U.S. PATENT DOCUMENTS

| | | | |
|---|---|---|---|
| 1,492,582 | 5/1924 | Smith . | |
| 2,275,772 | 3/1942 | Koch | 126/299 |
| 3,089,479 | 5/1963 | Perl | 126/21 R |
| 3,180,331 | 4/1965 | Jenn et al. | 126/21 R |
| 3,384,067 | 5/1968 | Rawald et al. | 126/21 R |
| 3,514,577 | 5/1970 | Dills et al. | 219/400 |
| 3,514,578 | 5/1970 | Dills | 219/400 |
| 3,576,417 | 4/1971 | Tingley | 219/10.55 D |
| 3,783,219 | 1/1974 | Tateda | 219/10.55 D |
| 3,818,171 | 6/1974 | Miller et al. | 219/10.55 R |
| 3,819,900 | 6/1974 | Ironfield | 219/10.55 R |
| 3,867,605 | 2/1975 | Yee | 219/10.55 F X |
| 3,973,551 | 8/1976 | Caselani et al. | 126/21 A |
| 4,011,803 | 3/1977 | Pfaffinger | 98/115 K |
| 4,036,151 | 7/1977 | Shin | 219/10.55 R X |
| 4,123,643 | 10/1978 | Burke | 219/10.55 R |
| 4,131,779 | 12/1978 | Tatsukawa et al. | 219/10.55 R |
| 4,144,436 | 3/1979 | Hauck | 219/10.55 F |

OTHER PUBLICATIONS

Litton Corp. Brochure, "*Litton Has the Answer*", 7–76.

*Primary Examiner*—Arthur T. Grimley

*Attorney, Agent, or Firm*—Bernard J. Lacomis; Radford M. Reams

[57] ABSTRACT

A composite structure for a microwave oven housing having a main frame defined by top, rear and bottom surfaces and being open along the front thereof is disclosed. A partition wall is disposed in the main frame intermediate the side edges thereof for providing and separating a cooking chamber and a control compartment. A rectangular door frame is connected to front edge portions of the top and bottom surfaces of the main frame in front of the chamber for connecting an oven door thereto, the door frame defining an opening for access to the chamber. An additional feature includes a mode stirrer housing and a waveguide mounted on the top surface of the main frame above the chamber and compartment with the top surface defining openings which communicate between the compartment and waveguide and between the mode stirrer housing and chamber for transmitting a microwave signal generated in the compartment through the waveguide to the housing, and from the housing into the chamber.

6 Claims, 2 Drawing Figures

UNITIZED STRUCTURE FOR A MICROWAVE OVEN

BACKGROUND OF THE INVENTION

This invention relates generally to a unitized structure for housing a microwave oven having a cooking chamber and a control compartment provided within a single integrally formed three-sided main frame.

Microwave ovens known in the prior art have contained a cooking chamber and a control compartment formed on or in separate chassis' or housings. The separately formed housings are, in turn, associated with one another by placing them upon or within an additional chassis, housing or case. Where such prior art ovens are manufactured in large quantities, it is sometimes difficult to match a given cooking chamber housing and control compartment housing, and mate the same together to form a close fit between them because of the variations that normally occur in the structural dimensions of a large manufacturing run of chamber housings and control compartment housings. Becuase of such manufacturing variations, unsightly gaps may occur between the housings which require the use of additional trim parts and members to conceal them.

Moreover, such prior art ovens contain additional separate and distinct structural elements which require additional costly steps in the formation of a complete oven assembly.

By means of my invention, these and other difficulties previously encountered in the manufacture of microwave ovens are substantially overcome.

SUMMARY OF THE INVENTION

It is an object of my invention to provide a unitized microwave oven structure wherein the cooking chamber and oven control compartment are formed within a single integrally formed main frame.

It is a further object of my invention to provide a unitized microwave oven structure having a relatively high strength to weight ratio in comparison with other microwave oven assemblies known in the prior art.

Briefly, in accordance with these objects, I provide a unitized microwave oven structure comprising a main frame having top, rear and bottom surfaces and an open front. A partition wall is disposed in the main frame intermediate the side edges thereof for separating a cooking chamber from a control compartment. A door frame is provided for connecting an oven door thereto and is attached to front edge portions of the top and bottom main frame surfaces in front of the cooking chamber, the frame having an opening therein for access to the chamber.

Additional objects, features and advantages of my invention will become apparent to those skilled in the art from the following detailed description and attached drawings upon which, by way of example, only a preferred embodiment of my invention is illustrated.

DESCRIPTION OF THE PREFERRED EMBODIMENTS

Figure 1:
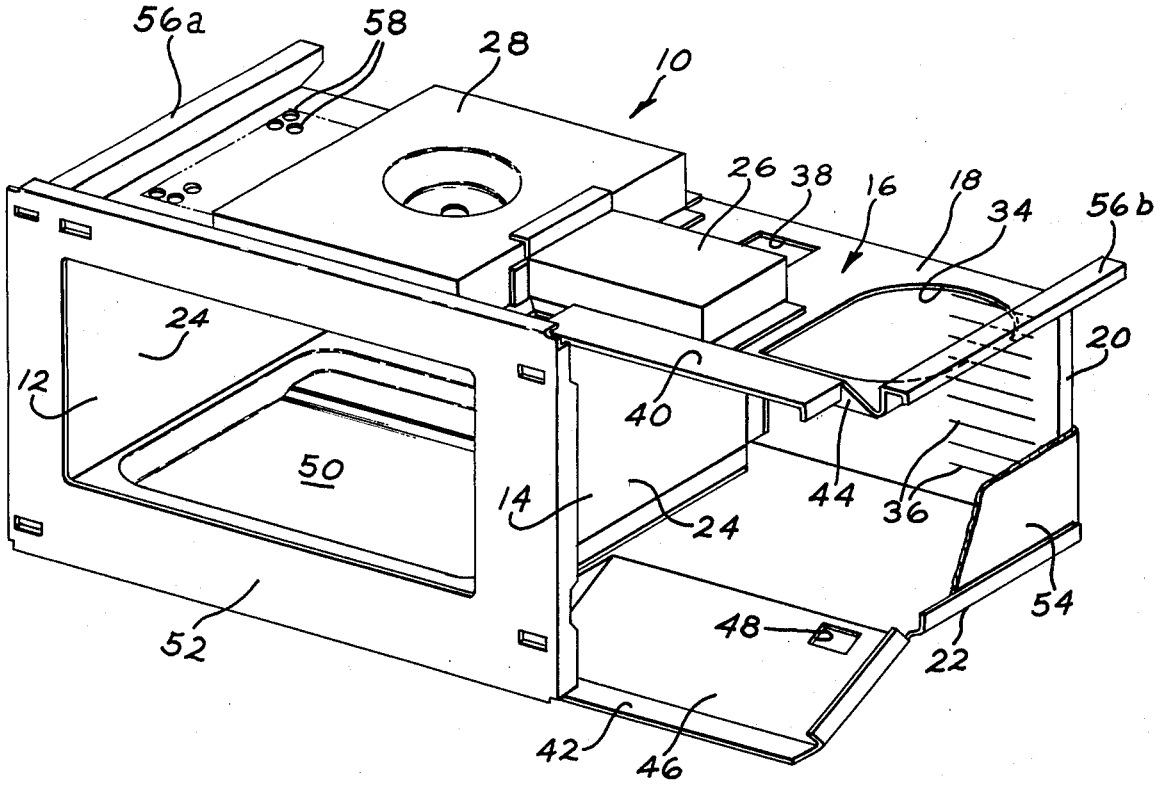
FIG. 1 shows an oblique projection of a unitized microwave oven structure thus illustrating one preferred embodiment of my invention.
Figure 2:
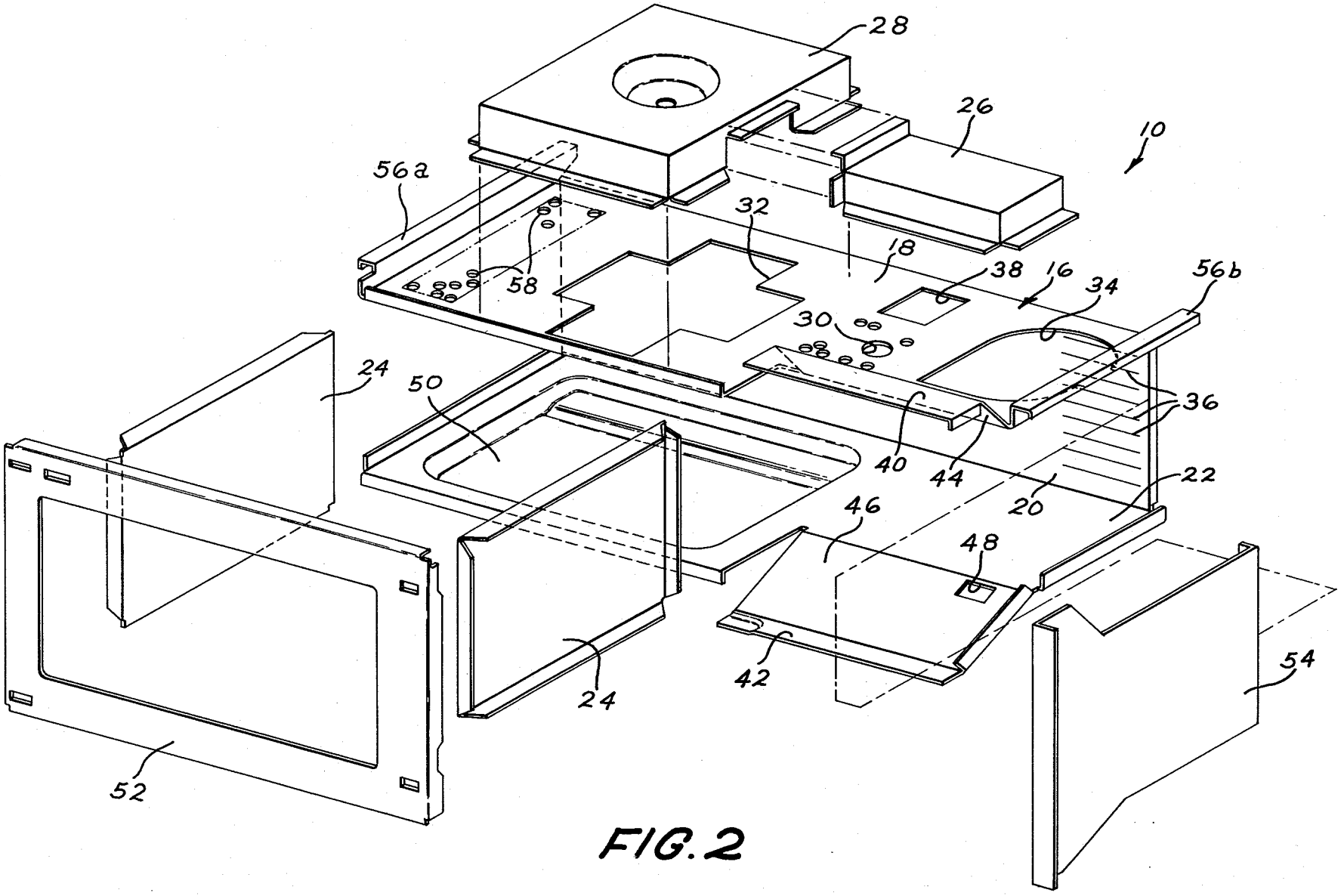
FIG. 2 shows an exploded oblique projection of the various component parts of the structure of FIG. 1.

Referring now to the drawings, there is shown, in one preferred embodiment of my invention, a metal oven structure 10 for housing a microwave oven chamber 12 and an oven control compartment 14. The chamber 12 and compartment 14 are located within a three-sided main-frame 16 having a top, rear and bottom surface 18, 20, and 22 and are separated from one another by a partition 24 carried by the surfaces and extending substantially at right angles thereto.

A microwave waveguide 26 and an adjoining mode stirrer housing 28 are mounted on the top surface 18 of the main frame 16. A microwave signal generated by a magnetron, not shown, located within the compartment 14 is introduced into the waveguide 26 through an opening 30 in the top surface 18. A mode stirrer, not shown, located within the housing 28 eradiates the chamber 12 to cook articles of food therein through an opening 32 in the top surface 18 overlying the cooking chamber. An opening 34 located in the top surface 18 over the control compartment 14 permits an air mover or blower, not shown, to be lowered into position therein for operating a microwave oven ventilating system or to be removed therefrom for maintenance or replacement. Fresh air for the ventilating system is drawn into the control compartment 14 by the blower, not shown, through a series of louvers 36 located in the rear surface 20 which communicate with said compartment. Excess air emitted from the control compartment which is not used to ventilate the adjacent cooking chamber 12 is vented from the control compartment 14 and main frame 16 through an opening 38 overlying the compartment 14 located in the top surface 18 to the rear of the waveguide 26.

A control panel, not shown, may be mounted on the front of the main frame 16 in front of the control compartment 14 between a pair of panel frames 40, 42. The frames 40, 42 are formed along extended front edge portions 44, 46, respectively, of the top and bottom surfaces 18 and 22. The extended edge portions 44, 46 and, in turn, integral parts of the main frame 16 such that they may be bent and folded as shown to provide an enlarged frontal opening into which a conforming control panel may be connected. An opening 48 is provided in the portion 46 to permit electrical access to the components in the control compartment 14 by means of electrical cable, not shown. A portion of the bottom surface 22 forming the floor of the cooking chamber 12 is pressed or stamped in a suitable and well known manner to provide a depression 50 for increasing the depth of the chamber 12. A frame 52 is attached to the front, top and bottom edges of the main frame 16 and partition 24 to which a swinging oven door, not shown, may be hingably connected for access to the cooking chamber 12.

A sidewall 54 closes the right side of the main frame 16. A pair of inverted L-shaped rails 56*a*, *b* are integrally formed along side edge portions of the top surface 18 to provide support means for the entire structure 10. The rails 56*a*, *b* are adapted to slide over and along elongated ledges formed on a support structure, not shown, so that the resulting assembly can be conveniently mounted to a wall or to the floor of an overhead wall mounted cabinet. Holes 58 formed above one side of the chamber 12 through the top surface 18 permit high pressure ventilating air introduced into the chamber 12 from the control compartment 14 to be vented from the structure 10.

The resulting structure 10, in particular the three-sided main frame 16, provides means for housing a microwave cooking chamber beside a microwave oven control compartment, all within a single unitized frame. The addition of the partition 24, door frame 52 and sidewalls 54 thereto permit the formation of a microwave oven housing having a high strength to weight ratio. Accordingly, an electronic components package for the oven can be integrated closely with a cooking chamber and separated effectively by a single partition as at 24. The single three-sided main frame 16 provides means for enlarging the front of the control compartment 14 wherein a control panel may be disposed. Thus, not only does the structure of my invention provide for location of a cooking chamber and control compartment within a single unitized main frame 16, the latter provides support for microwave generating and transmission components, power supplies, controls, an air ventilating system, and access means to and between the chamber 12 and compartment 14. Moreover, the various metal components of the structure 10, including the main frame 16, partition 24, and door frame 52 are readily weldable to one another in the usual well known manner to form a high strength, unitized assembly which permits reasonable manufacturing variations to occur between similar components in large manufacturing lots. The resulting structure 10 is adapted for insertion into a support and hood structure described in detail in copending commonly assigned application Ser. No. 935,433, filed in the joint names of James A. White and Frank L. Rice, entitled COMBINATION MICROWAVE OVEN AND EXHAUST VENT AND INSTALLATION MOUNTING METHOD THEREFOR, which disclosure is hereby incorporated by reference. The structure disclosed in the aforementioned application is adapted for mounting against a wall or to the floor of an overhead wall cabinet, or for insertion into a case for mounting on a counter top. The unitized structure 10 may, in the alternative, be inserted within a built-in wall case so that the front of the main frame 16 with oven door and control panel attached to the front thereof, is mounted approximately flush with a supporting wall, thus giving the unit a built-in appearance. The unitized structure is, in addition, made to permit air ventilation patterns of the type described in detail in copending commonly assigned application Ser. No. 935,436, filed in the names of James A. White, Frank L. Rice, and Walter E. Lewis, and entitled *VENTILATION SYSTEM FOR COMBINATION MICROWAVE OVEN AND EXHAUST VENT*, which disclosure is also hereby incorporated by reference.

Although the present invention has been described with respect to specific details of a certain preferred embodiment thereof, it is not intended that such details limit the scope of my invention otherwise than as set forth in the following claims.

I claim:

1. A simplified structure for use in forming a microwave oven having a cooking chamber, a control compartment and an access door comprising a generally U-shaped in cross section main frame having integral top, rear and bottom surfaces and an open front, a partition wall carried by said surfaces and extending substantially at right angles thereto for subdividing the space intermediate said top, rear, and bottom surfaces, for separating the cooking chamber from the control compartment, and a door frame adapted for connecting the oven door thereto, said door frame attached to said top and bottom surfaces in front of said cooking chamber, said frame defining an opening therein for access to said chamber.

2. The structure of claim 1 further comprising a mode stirrer housing mounted on said top surface above said chamber, and a waveguide mounted on said top surface above said compartment and being connected to said housing, said top surface having a first opening therein communicating with said compartment and waveguide, said top surface also having a second opening therein communicating with said housing and chamber for permitting a microwave signal to be introduced into said waveguide and transmitted into said chamber from said housing.

3. The structure of claim 1 wherein said rear surface includes a rear opening communicating with said compartment for permitting a mass of ventilating air to be drawn therethrough into said compartment, and said top surface includes a top opening overlying said compartment for permitting at least a portion of the air drawn into said compartment to be exhausted therefrom.

4. The structure of claim 1 further comprising aperture means in said top surface overlying the chamber for ventilating said chamber.

5. The structure of claim 1 further comprising vertical sidewalls closing the space defined by said top, rear and bottom surfaces adjacent the opposite ends of said main frame.

6. The structure of claim 1 wherein said bottom surface forms a depression communicating with said chamber for increasing the height of said chamber.

* * * * *